United States Patent [19]

Delahaie

[11] 4,149,763

[45] Apr. 17, 1979

[54] ARTIST'S EASEL BOX

[76] Inventor: Maurice P. Delahaie, 17/7 Boulevard Solferino, 92500 Rueil Malmaison, France

[21] Appl. No.: 833,891

[22] Filed: Sep. 16, 1977

[30] Foreign Application Priority Data

Sep. 29, 1976 [FR] France ..... 76 29317

[51] Int. Cl.[2] ..... A47B 97/08

[52] U.S. Cl. ..... 312/231; 248/449; 248/461

[58] Field of Search ..... 312/231; 206/1.7; 248/461, 448, 449; 190/11

[56] References Cited

U.S. PATENT DOCUMENTS

| | | | |
|---|---|---|---|
| 2,032,872 | 3/1936 | Friederichs | 248/449 |
| 2,751,271 | 6/1956 | Dessertenne et al. | 312/231 |
| 3,114,215 | 12/1963 | Turkin | 248/449 |
| 3,168,363 | 2/1965 | Monsour | 312/233 |
| 3,202,471 | 8/1965 | Wilson | 248/461 |
| 3,759,482 | 9/1973 | Wright | 248/449 |
| 3,926,398 | 12/1975 | Vincent | 248/448 |

FOREIGN PATENT DOCUMENTS

| | | | |
|---|---|---|---|
| 926435 | 10/1947 | France | 312/231 |
| 1050431 | 1/1954 | France | 248/461 |
| 1450682 | 7/1966 | France | 248/461 |

*Primary Examiner*—Mervin Stein
*Assistant Examiner*—Alex Grosz
*Attorney, Agent, or Firm*—Cushman, Darby & Cushman

[57] ABSTRACT

The easel box comprises a parallelepipedic casing on which are hingedly mounted at least three telescopic legs and a canvas supporting structure, said supporting structure comprising a panel structure having a planar face and four peripheral side ledges. Canvas supporting means comprises a T-square structure provided with upper securing means and slidably mounted on the side of said panel structure opposite to said plane face, and lower pivoting supporting means slidably mounted on said side ledges of said panel structure. T-square structure is entirely concealable within said panel structure.

9 Claims, 3 Drawing Figures

ARTIST'S EASEL BOX

BACKGROUND OF THE INVENTION

1. Field of the Invention

The present invention relates to an easel box in which the canvas supporting structure and the telescopic legs are hingedly mounted on the box and collapsible so as to provide an assembly which is compact and easy to transport and store.

2. Description of the Prior Art

Easel boxes of this type are known in the art and comprise a generally parallelepipedic case forming a housing on which are hingedly mounted telescopic legs, generally 3 in number, and a canvas supporting structure substantially consisting in a rectangular frame which is pivotally mounted at a small side thereof on the case to fit therewith in a closed configuration and having means for engaging and securing a canvas, said means comprising a lower supporting ledge and a securing T-square structure slidably mounted on said rectangular frame. Such an easel box is disclosed for instance in French Pat. No. 926,435 published on Oct. 1st, 1947.

In closed configuration, such an easel box presents a side from which project the two arms of the T-square structure and the lower supporting ledge. Said arrangement may be useful for transporting canvas together with the easel box, but such an utilisation is not systematic and, since the projecting or protruding elements are generally made of delicately worked wood pieces, they often suffer injuries or damages during transport and storage of the easel box. Further, said elements are broadly designed and dimensioned for increasing the mechanical strength thereof, whereby making the easel box considerably heavier.

Moreover, in opened configuration, such an easel box does not present an adequate working surface since the means for guiding and supporting the T-square structure project from the front plane defined by the rectangular shaped edges of the case whereby, since the canvas is held only at its upper end by the transverse arm of the T-square structure, said arm has also to be designed large enough to insure the canvas to be firmly held onto the easel, without a tendancy of twisting, even with gusts of wind. The T-square structure and the elements for supporting same must be accordingly broadly dimensioned, whereby making the easel box still heavier and accordingly increasing the manufacturing costs.

OBJECTS OF THE INVENTION

There is an object of the present invention to obviate the drawbacks of the easel boxes of the prior art by providing an improved easel box which is light and presents a canvas supporting structure forming in closed configuration a cover completely flat and without useless projecting elements.

There is another object of the present invention to provide an easel box comprising a canvas supporting structure forming a flat cover and having a canvas securing means which are all retractible, e.g. concealable when the easel box is in closed disposition.

Therefore, and according to a characteristic feature of the present invention, such an easel box comprises a canvas supporting means consisting in a panel structure having a plane face and adapted to come in contact position on an open face on the case forming the frame, said plane face thus forming the cover of the case, the securing means for securing a canvas on said panel structure comprising, on one hand, a T-square structure slidably mounted on the side of the panel structure opposite to said plane face so as to be totally retractible, e.g. concealable within the case, and on the other hand first pivoting hooking means slidably mounted on the lateral wall portions of the panel structure coming into contact with the lateral walls of the case.

According to another feature of the present invention, the concealable T-square structure is formed with a main arm slidably received within a slide formed in the portion of the panel structure opposite to said plane face, and a secondary or transverse arm provided at its ends with second pivoting hooking means, said transverse arm and said second hooking means being concealable within the panel structure for easy handling of the easel box in closed configuration.

Such an easel box presents the advantages of a lighter structure, of a lesser manufacturing cost and also, of offering in closed configuration a compact assembly, whereby reducing risk of damages for movable parts necessary to hold canvas on the easel.

Moreover, since the canvas suporting structure offers a serviceable working surface absolutely flat, the upper and lower securing members may be manufactured in an easy and economic manner. The lenght of the transverse arm of the T-square structure may be considerably reduced, whereby making same easily concealable within the canvas supporting structure. The thickness of said transverse arm can also be considerably reduced whereby saving space within the casing structure for receiving a larger drawer.

Such an easel-box also permits, if desired, to firmly position a canvas on the supporting structure in the closed configuration of the easel box for handling or transporting purposes.

BRIEF DESCRIPTION OF THE DRAWINGS

Further objects and advantages of the invention will become apparent from the following description and claims, and from the accompanying drawings, on which:

DETAILED DESCRIPTION OF THE DRAWINGS

Figure 1:
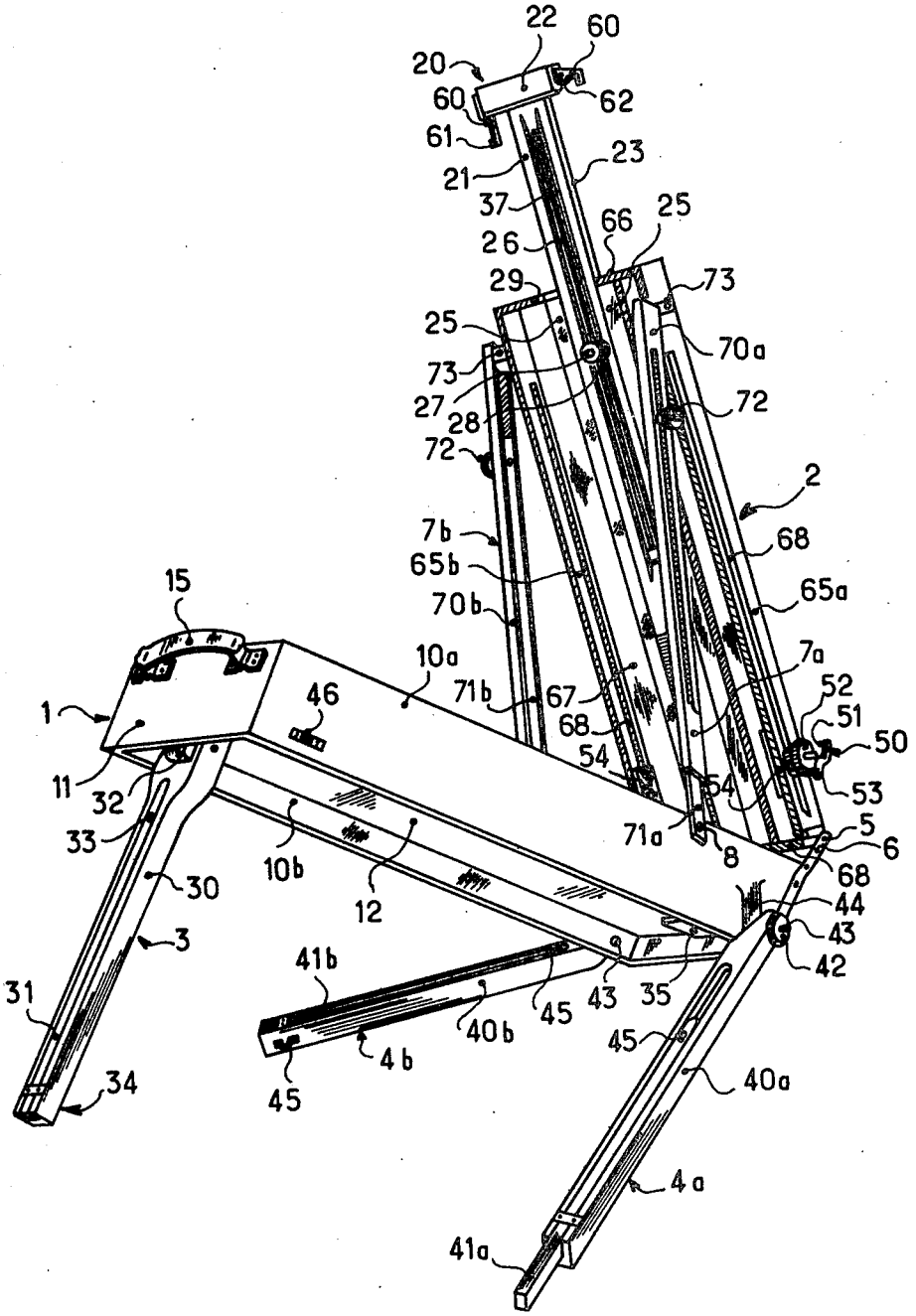
FIG. 1 is a perspective view showing an easel box of the invention with the folding elements partially spraid out.

Referring to the drawings, an easel box according to the invention comprises a casing, generally designted at 1, of a parallelepipedic shape presenting two side walls 10*a* and 10*b* and a frontwall 11. The front face opposite to front wall 11 is partially opened above a flat bottom 12 dividing the inner space defined by the casing 1 in a main upper space, for receiving, as known in the art, a drawer for arranging painter's accessories (not shown), and in a lower space for receiving at least one of the telescopic legs hingedly mounted on the casing.

In the embodiment shown on FIG. 1, three hinged telescopic legs, designated generally at 3, 4A and 4B, are mounted on casing 1. The central leg 3 is pivotally mounted on a supporting batten 32 attached to the inner surface of frontwall 11 and to the bottom 12. Said leg 3 comprises a main portion 30 forming a slide in which is telescopically and slidingly received a slider 31 which can be lockingly positioned within the slide 30 by a screw and nut locking device 33. In the embodiment shown in FIG. 1, said central leg 3 is received, in folded position, within the lower space defined by the casing 1 and the bottom 12 and is held in said folded position by means of microbuckles elements 35 such as those sold under trade mark "Velcro" arranged respectively on the end of the leg and on the bottom.

The side legs 4*a* and 4*b* are pivotally mounted on the side walls 10*a* and 10*b* of the casing 1, respectively, by means of axes 43, said legs being locked in position by nuts 42 cooperating with threaded ends of axes 43. In closed configuration, the extremities of the legs 4*a* and 4*b* opposite to axes 43 are held against the side walls 10*a* and 10*b*by ball and cam-fitting devices 46 and 46'. Said legs are positioned and received in working condition within inclined recesses 44 formed by the side walls 10*a* and 10*b* of casing 1. Said legs 4*a* and 4*b* are formed, as leg 3, with a main slide portion 40*a*, 40*b*, respectively, for slidably receiving a telescopic slider 41*a*, 41*b*, respectively, which can be lockingly positioned within the slide 40*a*, 40*b*, by screw and nut locking devices 45.

Figure 2:
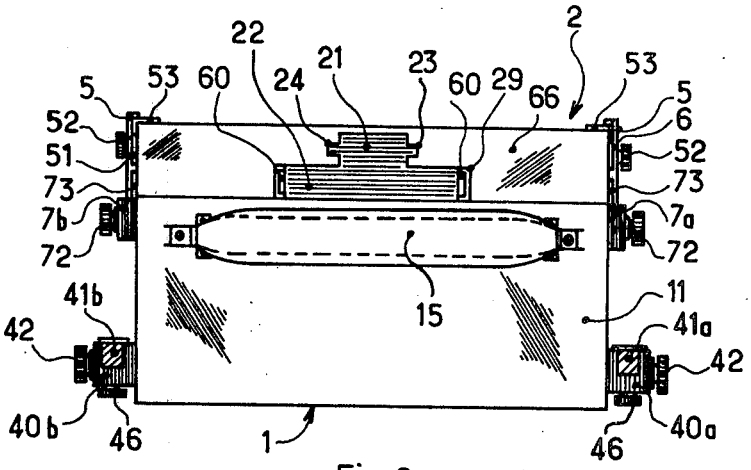
FIG. 2 is a front view of the easel box of FIG. 1 in closed configuration.
Figure 3:
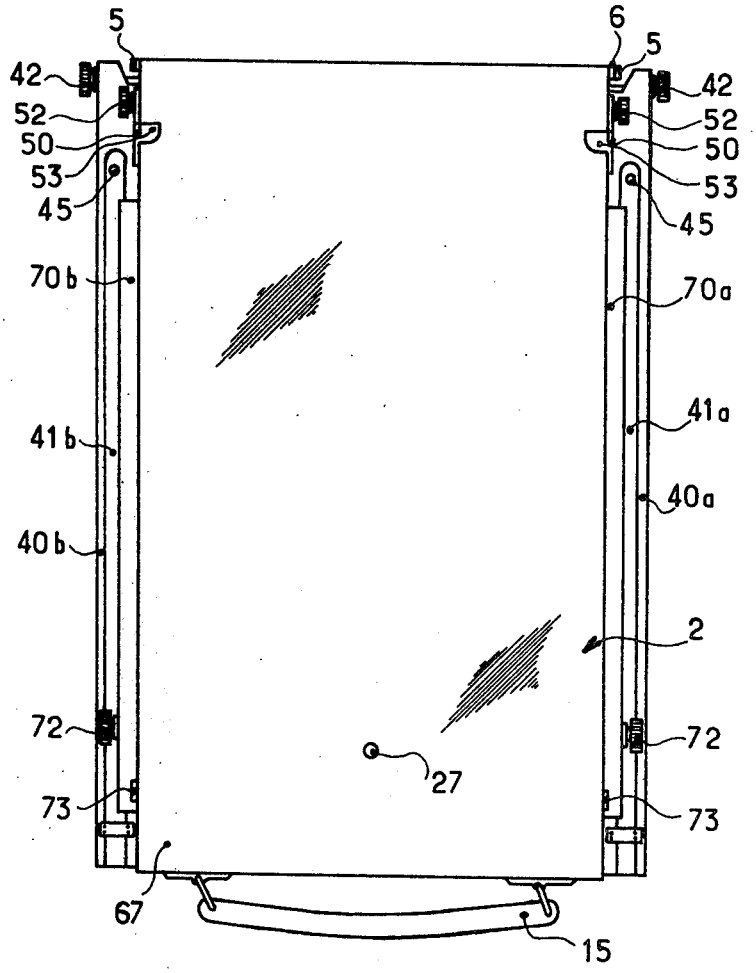
FIG. 3 is an elevational view of the easel box in the configuration shown on FIG. 2.

The canvas supporting structure which forms a tilting working surface is generally designated at 20. Said canvas supporting structure is pivotally mounted at its lower end by hinge pin 5 received in offset supporting members 6 secured to the side walls 10*a* and 10*b* of casing 1. The panel structure 2 is supported and adjustably set in angular relationship with respect to casing 1 by means of two telescopic supporting arms 7*a* and 7*b* pivotally mounted at one end on tabs 73 attached to the side walls or ledges 65*a*, 65*b* of the panel structure 2, and at the opposite end on the side walls 10*a* and 10*b* of the casing 1 by means of pins 8. Said supporting arms 7*a* and 7*b* are comprised of a slide 70*a*, 70*b*, respectively, in which slidably received a slider 71*a*, 71*b*, respectively, said sliders being pivotally secured to pins 8 adjustably and lockingly positioned within the slides 70*a*, 70*b*, respectively by a screw and nut locking device 72. The canvas supporting panel structure 2 comprises a rectangular frame formed by side ledges 65*a* and 65*b* and front ledges 66 and 68. Said frame is closed at its upper surface by a plane wall 67 which forms with the rectangular frame a light and strengthened box structure. On the inner side of the wall 67 are attached longitudinally extending lathes 25 which form a slide in which is slidably received the main arm 21 of the securing T-square structure, generally designated at 20. The main arm 21 of T-square structure 20 is formed along its lateral sides with longitudinally extending tenons 23 adapted for sliding in the slide formed by the lathes 25. A transversing slot 26 is formed in the bottom of a mortise 37 grooved in the inner face of arm 21 to cooperate with a locking device of the screw and nut type, respectively designated at 27 and 28. Referring to FIG. 3, it will be noted that the screw 27 comprises a head, for instance countersunk, which is embedded in the wall 67 in order not to project from the upper or external plane face of said wall 67. The transverse arm 22 of T-structure 20 is arranged, as best shown in FIGS. 1 and 2, on the inner face of main arm 21 so as to be entirely received within a recess 29 formed in the front ledge 66 of supporting structure 2. Upper securing members 60 are pivotally mounted by means of hinge pins 62 on the lateral ends of transverse arm 22. Said securing members 60 have the form of an arm prolongated by a hook 61. On FIG. 1, there is shown the left securing member 60 in folded position, i.e. the position corresponding to the configuration for introducing the transverse arm 22 of T structure 20 within the recess 29 in the front ledge 66 of supporting structure 2. There is also shown in FIG. 1 the right securing member 60 in unfolded position, corresponding to the configuration where said member is ready to engage the upper stile of a canvas frame to be secured on the supporting structure. It will be understood that the length of main arm 21 is determined so as to permit the transverse arm 22 to be entirely received within recess 29 when the T-square structure is retracted within the supporting structure 2.

Lower canvas supporting members 50, having the form of a contoured plate portion and comprising one end 51 forming a hook, are slidably mounted on side ledges 65*a* and 65*b* of the supporting structure by means of a screw and nut locking device 52 which is adapted to slide within a transversing slot 68 formed in said side ledges 65*a* and 65*b*, in cooperation with a guiding block 54 in sliding contact onto inner face of said side ledges 65*a* and 65*b*. The lower canvas supporting member 50 shown in FIG. 1 is in unfolded configuration, where it is ready for receiving the lower style of a canvas frame. Said pivoting securing member 50 is locked in unfolded position by a stop 53, which projects perpendicularly from the general plane of member 50 and abuts against the external plane surface of wall 67. In folded position, as shown on FIGS. 2 and 3, the end portion 51 of member 50 forming a hook is folded over the corresponding side ledge 65*a* or 65*b* of the supporting structure and the part forming a stop 53 comes in a position where its flat surface is laying onto the planar external surface of wall 67. Said canvas securing member 50 can thus be locked in position by screw and nut devices 52, as shown on FIGS. 2 and 3. Upper and lower canvas supporting member are advantageously made from a punched, contoured and folded metallic plate.

As better shown on FIGS. 2 and 3, when leg 3 has been folded and received within the lower space defined by the casing 1 and when the side legs 4*a* 4*b* have been retracted and locked at one end by the fitting devices 46, and at the other end by the nuts 42, then the T-square structure 20 has been retracted within the panel structure 2 and when the lower securing members 50 has been pivoted against the side ledges 65*a* and 65*b*, the easel box of the invention offers the configuration of a compact assembly where all the movable members are lockingly arranged on the side walls of the closed case formed by the casing 1 overlapped by the supporting structure 2 acting as a cover.

It is further to be noted that in working or utilization configuration, the external surface of wall 67 offers a bearing surface absolutely flat for the canvas, whereby same is firmly held against the supporting structure at the lower end by the lower canvas securing member 50 and at the upper end by the upper canvas supporting members 60 on the T-structure 20, any tendancy of twisting of the canvas being prevented by the great surface of contact between the stiles of the canvas frame and the external surface of wall 67.

The easel box of invention also offers the possibility of directly securing thereto paper sheets, for water colour painting or wash drawings, for instance by means of adhesive tapes, or when made of wood, with drawing-pins.

As already mentioned, it is also possible to slightly extend the T-square structure 20 from the supporting structure 2 for releasing hooks 61 and making same pivot, as also the lower securing members 50, lockingly positioned at the acurate level for firmly jamming a canvas frame therebetween against the supporting structure, whereby allowing easy handling and transporting of the canvas together with the easel box in closed configuration.

Front wall 11 of the casing 1 is advantageously provided with a handle 15 for easier handling of the easel box alone or with a canvas frame secured thereto as above described.

While a specific embodiment of an easel box according to the invention has been disclosed in the foregoing description, it will be understood that various modifications within the spirit of the invention may occur to those skilled in the art. The easel is preferably made of wood pieces, relected from various species to provide suitable strength and aesthetic look, but at least some components can be made of agglomerated wood and/or metal and plastics.

For instance, in the case of an easel box of large size, the 3 telescopic legs can be mounted to be received within the lower space defined in casing 1, as leg 3 previously disclosed. The pivoting securing members 50 or 60 can also be substituted by other securing devices adapted to be retracted in rest position within recess 29 or against side ledges 65*a* and 65*b* of supporting structure 2. For instance, such a securing upper member 60 may be slidably mounted on an extending hinge pin 62 secured to transverse arm 22 so as to control its overhung position with respect to main arm 21 of the T-square structure, said securing member being for instance lockingly positioned on pin 62 by a locking screw. In the same manner, in order to increase the reach of the lower securing members 50, said members may be constituted with telescopic portions with spring-balls or notched positioning and locking device. Accordingly, the present invention is intended to embrace all alternative modifications and variations within the spirit and the scope of the appended claims.

What I claim is:

1. An artist's easel box, comprising:

a parallelepipedic casing forming a box, said casing having two lateral side walls, an end wall and a bottom wall, thereby defining an open top face and an adjacent open front face;

at least three telescopic legs and a canvas supporting means being hingedly mounted on said casing; and means for lockingly adjusting the tilting of said canvas supporting means with respect to said casing;

wherein, said canvas supporting means comprises:

a substantially rectangular canvas supporting structure including a top wall having an outer plane surface, and two side walls extending perpendicularly to said top wall, said supporting structure being adapted to pivotally come in mating overlaying position on said open top face of said casing to constitute a flat surface hinged cover for said casing, and adjustable canvas securing means between which a canvas may be clamped for firmly holding that canvas on said canvas supporting structure, said canvas securing means comprising:

first securing means comprised by a T-square structure slidably mounted on the inner face of said top wall opposite to said outer plane surface, said T-square structure comprising:

a main arm slidably and guidingly received within a slide disposed on said inner face of said top wall, and a secondary arm extending perpendicularly to said main arm and attached to the side of said main arm opposite to said plane surface of said top wall at one end of said main arm, first pivoting hooking means being mounted at the opposite end of said arms, said secondary arm and said first hooking means being totally concealable within said canvas supporting structure provided said T-square structure is collapsed; and second securing means comprising second hooking means slidably mounted on said side walls of said canvas supporting structure.

2. An easel box according to claim 1, wherein:

said first pivoting hooking means comprises flat hook members each extending in a plane substantially perpendicular to said secondary arm.

3. An easel box according to claim 1, wherein: said second hooking means comprises:

two contoured tabs having a substantially flat main portion extending parallel to said side wall of said canvas supporting structure, and a substantially flat protruding portion extending perpendicularly to said main portion to selectively come into surface contact with said plane surface of said top wall, each tab being mounted to be slidable along the corresponding said side wall of said canvas supporting structure, and releasable means being provided for tightening said main portion of each tab against the corresponding side wall.

4. An easel box according to claim 3, wherein:

said contoured tabs are made from a punched and conformed metallic plate.

5. An easel box according to claim 3, wherein:

each contoured tab is slidably mountd in a transversing slot formed in said corresponding side wall of said canvas supporting structure.

6. An easel box according to claim 3, wherein: said canvas supporting structure further comprises:

an end wall extending perpendicuarly to said top wall and to said side wall, said end wall being formed with a contoured opening, the shape of which corresponds to the outer cross-sectional contour of said T-square structure equipped with said first hooking means, whereby said secondary arm supporting said first hooking means may be received within said opening when said T-square structure is collapsed within said canvas supporting structure.

7. An artist's easel box, comprising:

a parallelepipedic casing forming a box with two open adjacent sides;

at least three telescopic legs and a canvas supporting means being hingedly mounted on opposite sides of said casing so that said canvas supporting means may be pivoted in mating overlaying position over one of said open adjacent sides;

means for lockingly adjusting the tilting of said canvas supporting means with respect to said casing;

said canvas supporting means comprising:

a panel structure having a top wall with a plane outer surface;

an end wall and side walls extending perpendicularly to said plane surface, said panel structure thus constituting a flat surface hinged cover for said casing;

adjustable canvas securing means on said panel structure, said canvas securing means comprising:

a T-square structure slidably mounted on the side of said top wall opposite to said plane outer surface so as to be totally concealable within said panel structure; and a pair of canvas supporting members slidably mounted on said side walls of said panel structure;

wherein said T-square structure comprises:

a substantially flat parallelepipedic main arm slidably and guidingly received within a slide formed of two lathes extending longitudinally and secured to said side of said top wall opposite to said plane outer surface, and a secondary arm attached to the side of said main arm opposite to said plane outer surface at one end thereof;

pivotable hooking members being mounted on opposite ends of said secondary arm, said pivotable hooking members being adapted to pivot in planes perpendicular to said secondary arm between a first inoperative position and a second position where said members extend substantially perpendicularly to the plane of said top surface and beyond said top surface;

said secondary arm and said hook members being slidingly totally concealable within said panel structure through a suitably contoured opening formed in said end wall of said panel structure; said canvas supporting members comprising:

two contoured tabs having a substantially flat main portion extending parallel to said side walls of said panel structure and having a substantially flat projecting portion which extends perpendicularly to said main portion so as to selectively come into surface contact with said plane outer surface of said panel structure, each tab being mounted so as to be slidable along the corresponding said side wall of said panel structure; and releaseable means being provided for locking said hooking members in position onto said side walls.

8. An artist's easel box, comprising:

a parallelepipedic casing forming a box with an open top face and an adjacent open front face;

a canvas supporting structure hingedly supported by a lower end thereof on hinged means mounted on said casing at the level of the corners thereof adjacent said open faces;

means for lockingly adjusting the tilting of said canvas supporting structure with respect to said casing;

means for hingedly mounting at least three telescopic legs on a portion of said casing opposite to said open top face;

said canvas supporting structure comprising:

a panel having a flat upper surface;

two lateral walls extending perpendicularly to said panel in the direction opposite to said upper surface;

a first or upper canvas holding means comprising a main arm slidably and guidingly received within a slide on the face of said panel opposite to said upper surface;

a secondary arm transversally mounted at the end of said main arm opposite to said hinge means for said canvas supporting structure;

first hooking means being pivotally mounted at the opposite ends of said secondary arm so as to pivot in planes substantially perpendicular to said secondary arm so as to extend beyond said upper surface of said panel; and second canvas holding means consisting in a pair of second hooking means pivotally mounted on said lateral walls so as to pivot in planes perpendicular to said panel, said second hooking means being further slidably mounted on said lateral walls of said canvas supporting structure, whereby said first canvas holding means are totally concealable within said canvas supporting structure and said second holding means may be substantially pivoted in an inoperative position along said lateral walls of said canvas supporting structure.

9. An artist's easel box according to claim 8, wherein:

said canvas supporting structure further comprises:

a front wall opposite to said hinged means and extending perpendicular to said panel in the direction opposite to said upper surface thereof, said front wall being formed with an opening, the internal contour of which mates the outer cross-sectional contour of said first holding means.

* * * * *